US010688406B2

(12) United States Patent
Menow

(10) Patent No.: US 10,688,406 B2
(45) Date of Patent: Jun. 23, 2020

(54) REUSABLE PIÑATA SYSTEM AND ITS ASSOCIATED METHOD OF OPERATION

(71) Applicant: Steven Menow, Yardley, PA (US)

(72) Inventor: Steven Menow, Yardley, PA (US)

( * ) Notice: Subject to any disclaimer, the term of this patent is extended or adjusted under 35 U.S.C. 154(b) by 0 days.

(21) Appl. No.: 16/388,825

(22) Filed: Apr. 18, 2019

(65) Prior Publication Data

US 2019/0329146 A1 Oct. 31, 2019

Related U.S. Application Data

(60) Provisional application No. 62/664,019, filed on Apr. 27, 2018.

(51) Int. Cl.
*A63H 37/00* (2006.01)

(52) U.S. Cl.
CPC ..... *A63H 37/00* (2013.01)

(58) Field of Classification Search
CPC ..... A63H 37/00
USPC ..... 446/73, 5, 365
See application file for complete search history.

(56) References Cited

U.S. PATENT DOCUMENTS 3,228,556 A 1/1966 Nonestied
4,167,078 A 9/1979 Oquita
4,174,048 A 11/1979 Volpe, Jr.
4,848,593 A 7/1989 Jeandaud
5,752,620 A 5/1998 Pearson
5,934,516 A 8/1999 Strycharske et al.
6,354,904 B1 * 3/2002 Grey ..... A63H 37/00 446/487
6,763,971 B1 7/2004 Tong
6,860,403 B1 3/2005 Mehrens et al.
6,918,509 B2 7/2005 Baker et al.
7,442,106 B1 * 10/2008 Menow ..... A63H 37/00 446/365
9,630,748 B2 * 4/2017 Keller ..... B65D 31/10

* cited by examiner

*Primary Examiner* — Vishu K Mendiratta
(74) *Attorney, Agent, or Firm* — LaMorte & Associates, P.C.

(57) ABSTRACT

A piñata defined in part by a front wall and a flap that selectively covers an open bottom. The flap is positionable between an open and closed position. Box holes are formed through the front wall. At least one finger extends from the flap. Each finger has a key hole formed there through. Each finger abuts against the front wall so that each key hole aligns with a box hole. A removable pull tab extends through the box hole and through the key hole wherever the box hole and key hole align. The presence of the removable pull tab prevents the flap from moving to an open position under the weight of the loose objects. When all the pull tabs that engage a key hole are removed, the flap can swing to an open position.

19 Claims, 5 Drawing Sheets

REUSABLE PIÑATA SYSTEM AND ITS ASSOCIATED METHOD OF OPERATION

RELATED APPLICATIONS

This application claims the benefit of U.S. Provisional patent application No. 62/664,019 filed Apr. 27, 2018.

BACKGROUND OF THE INVENTION

1. Field of the Invention

The present invention relates to piñatas and other novelty devices that hold a volume of candy or toys that are dispensed when the novelty device is opened. More particularly, the present invention relates to piñatas and similar novelty devices that are refillable and reusable.

2. Prior Art Description

Traditionally, a piñata is a three-dimensional construct that is filled with candy and/or small prizes. The construct is suspended and struck with a stick until it is broken and the contents spill onto the floor. Original piñatas were made from clay pots and the word piñata comes from the word 'pignatta' which means fragile pot. In Europe, the tradition of filling a piñata and striking it became a religious activity associated with the first Sunday of Lent. This religious tradition spread to Spain in the 14th century. Spanish missionaries then brought this tradition to the Americas. Native Aztec Indians had a similar game to celebrate the Aztec god of war and soon the two traditions merged. Over the years, the use of a piñata changed from a religious activity to a celebratory activity. Piñatas are now used to celebrate holidays and special days, such as birthdays.

Modern piñatas are no longer made of clay. Rather, for the sake of both cost and safety, most piñatas are made of papier-mâché. However, the piñata is still filled with candy and/or small toys. The piñata is also still broken open by having blindfolded children take turns swinging a stick and trying to strike the piñata.

The act of blindfolding a child and then having that child swing a stick wildly toward a piñata presents obvious dangers. It is not uncommon for a blindfolded child to swing a stick and strike another child or a breakable object. Furthermore, when a child does strike a piñata, the piñata typically does not open fully. Rather, it opens a little and some candy falls out. This causes other children to run to the piñata while the blindfolded child is still swinging the stick. Again, an obvious danger is presented.

In an attempt to make piñatas less dangerous, piñatas have been redesigned with non-violent release mechanisms. For instance, in U.S. Pat. No. 4,167,078, to Oquita, entitled. Pull-Pin Piñata, a piñata is shown having a hidden door. Numerous strings are loosely glued to the door. Only one of the strings is tied to the door. If a child pulls one of the loosely glued strings, the string pulls free and the door remains closed. However, when a child pulls the one tied string, the door opens and the contents of the piñata fall to the floor.

Such prior art pull-string piñatas share one undesirable feature with traditional piñatas. The undesirable feature is the inability to conveniently reassemble and refill the piñata so it can be used again. Thus, the piñata has remained a disposable, one-use item.

In U.S. Pat. No. 7,442,106, to Menow, the applicant herein, a reusable piñata is provided that has a pull pin release. The piñata has multiple pull pins that can be randomly pulled by children. When the last of a selected group or pins is pulled, the piñata releases its contents. The piñata can then be refilled and reused.

The Applicant has improved up the initial design by making a piñata system that is both easier to use and easier to manufacture. The improved piñata system is described and claimed below.

SUMMARY OF THE INVENTION

The present invention is a reusable pinata assembly that includes a container box for holding loose objects, such as candy. The container box has an internal compartment that is defined in part by a front wall and a flap that selectively covers an open bottom. The flap is selectively positionable between a closed position that covers the open bottom and an open position that enables the loose objects to exit the internal compartment.

A plurality of box holes are formed through the front wall of the container. At least one finger extends from the flap, wherein each finger has a key hole formed therethrough. Each finger abuts against the front wall when the flap is in its closed position. Furthermore, each key hole aligns with a box hole from the plurality of box holes.

A removable pull tab extends through the box hole and through the key hole wherever the box hole and key hole align. The presence of the removable pull tab prevents the flap from moving to an open position under the weight of the loose objects resting on the flap. When all the pull tabs that engage a key hole are removed, the flap can swing to an open position, therein releasing the loose objects held within the container box.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

As with traditional piñatas, the present invention piñata can be made in many apes and styles. In the shown exemplary embodiment of the present invention piñata, the piñata has a fanciful shape. Such a shape is merely exemplary and is used only to illustrate the working components of the present invention piñata. It will therefore be understood that the present invention piñata can be produced in many different shapes and that the shown exemplary embodiment is not a limitation on the body appearances the present invention piñata may take. The illustrated embodiment merely sets forth one of the best modes contemplated for the invention. As such, the exemplary embodiment should not be considered a limitation when interpreting the scope of the appended claims.

Figure 1:
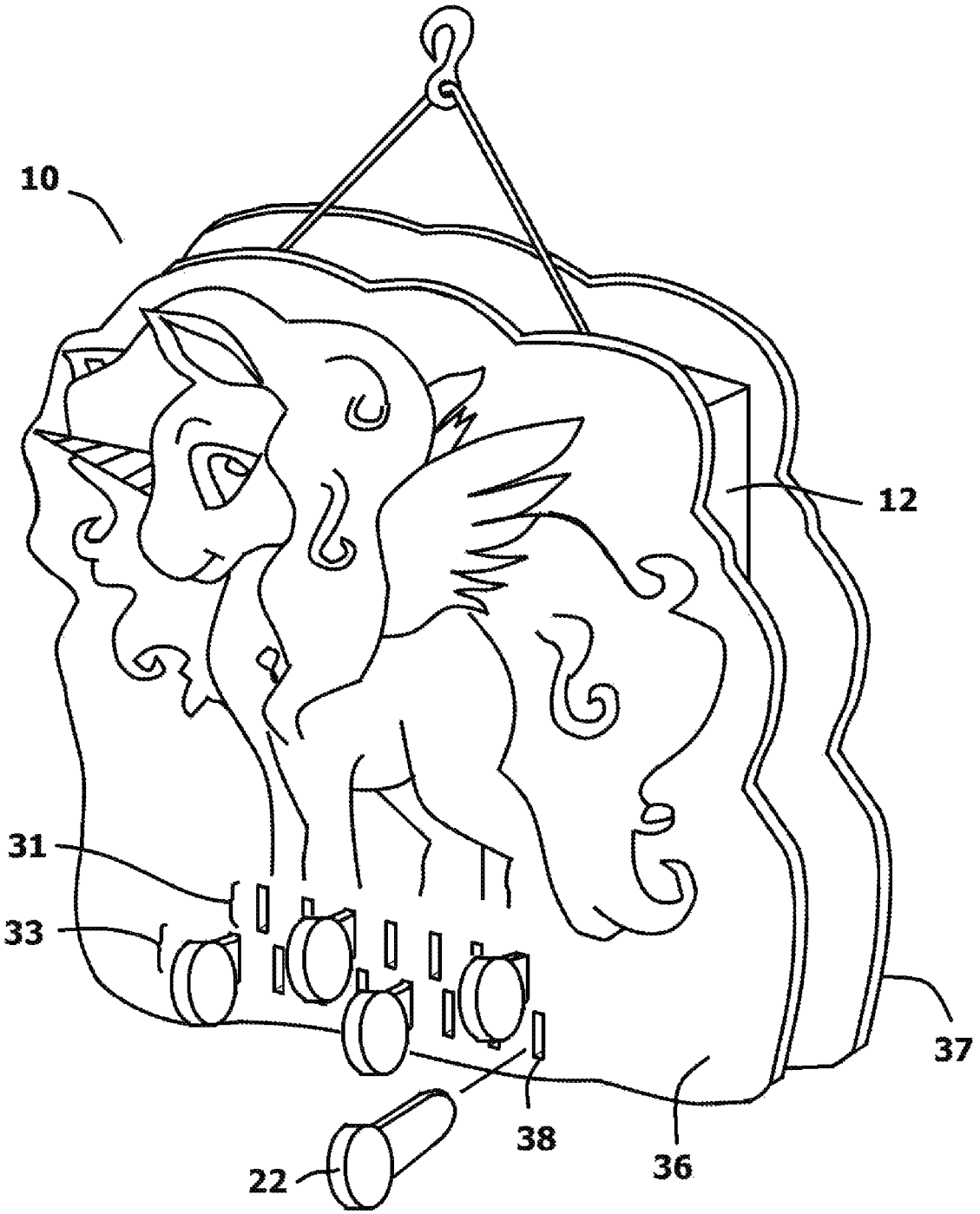
FIG. 1 shows an exemplary embodiment of the present invention reusable piñata shown in a closed condition.
Figure 2:
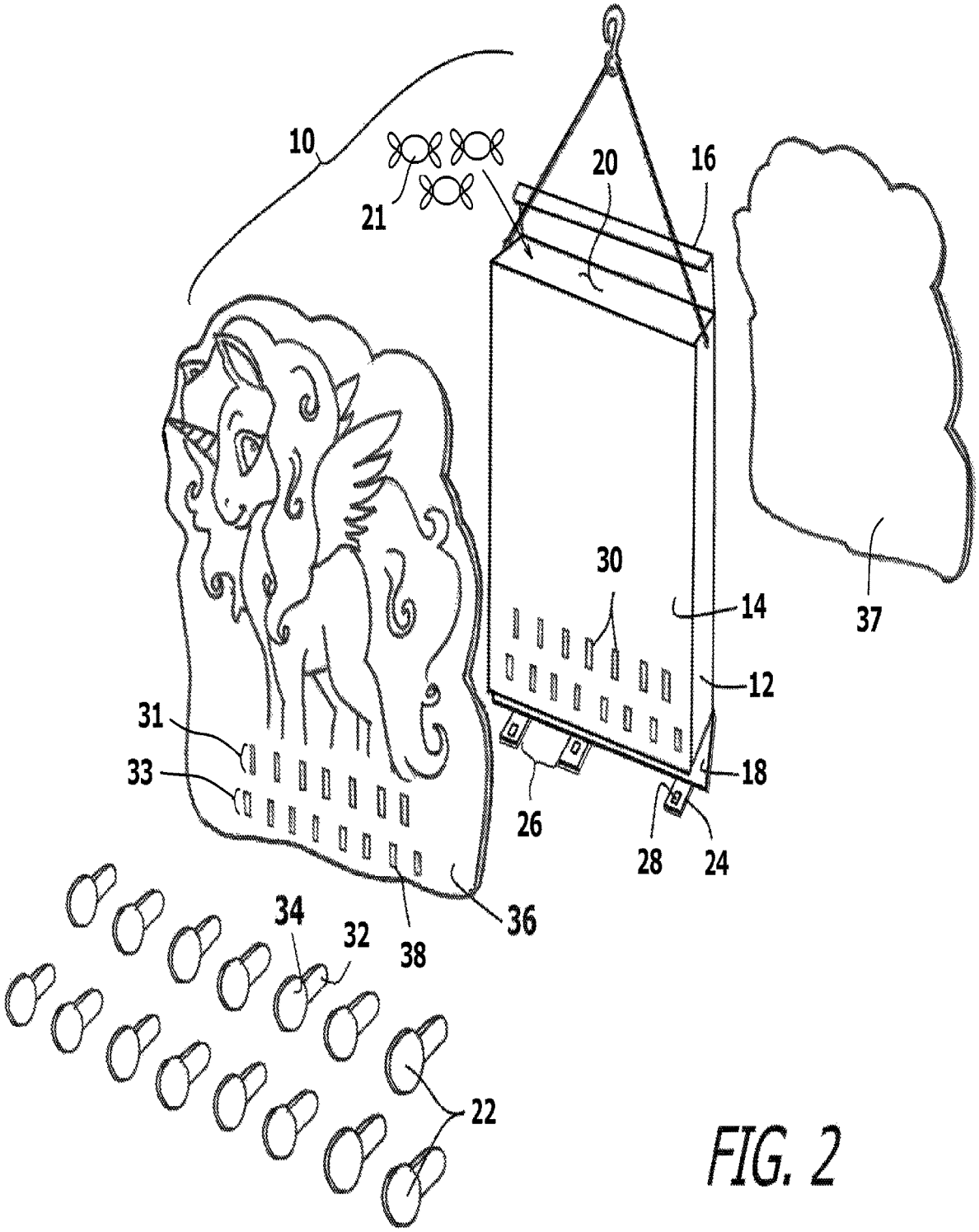
FIG. 2 is an exploded view of the exemplary embodiment of FIG. 1.

Referring to FIG. 1 and FIG. 2, a reusable piñata 10 is shown. The reusable piñata 10 includes a box 12 or similar container. The box 12 can have any shape and is preferably made from folded paperboard. The box 12 has a flat front wall 14, a top flap 16 and a bottom flap 18. The top flap 16 can be selectively unfolded to access an interior compartment 20 within the box 12 and to fill the box 12 with candy, prizes and/or other objects 21. Similarly, the bottom flap 18 can also be selectively unfolded to release candy, prizes and/or other objects 21 from the box 12.

A plurality of key holes 30 are formed in the front wall 14 of the box 12. In the shown embodiment, the key holes 30 are formed in a first row 31 and a second row 33. However, it will be understood that the key holes 30 can be arranged in a single row or multiple rows depending upon the size and design of the pinata 10.

The bottom flap 18 is biased open by gravity. The bottom flap 18 is further biased open by the weight of any candy, prizes and/or other objects 21 that are held inside the box 12. It will therefore be understood that the bottom flap 18 of the box 12 would automatically open if not held closed by a secondary release system.

The release system is a mechanical lock that utilizes pull tabs 22. The release system is activated when selected pull tabs 22 are pulled from the piñata 10. A plurality of fingers 24 extend from the bottom flap 18 of the box 12. The various fingers 24 are separated by gaps 26. The fingers 24 need not be evenly spaced. As such, the width of the gaps 26 between fingers 24 may vary.

Key holes 28 are formed in the fingers 24. The key holes 28 can be formed at different points along the length of each of the fingers 24. When the bottom flap 18 is closed, the key holes 28 on the fingers 24 align with some of the key holes 30 in the first row 31 and second row 33 on the front wall 14 of the box 12. Likewise, when the bottom flap 18 is closed, the gaps 26 between the fingers 24 align with some of the key holes 30 in the front wall 14 of the box 12. The number of key holes 30 on the front wall 14 of the box 12 greatly outnumber the fingers 24 and the key holes 28 on the fingers 24. Accordingly, only some of the key holes 30 on the front wall 14 of the box 12 will align with key holes 28 on the fingers 24 of the bottom flap 18. Most of the key holes 30 will align with the gaps 26 between fingers 24.

Each of the pull tabs 22 has an elongated body 32 and an enlarged head 34. The elongated bodies 32 are sized to pass into the key holes 30 in the front wall 14 of the box 12 and any key holes 28 from the bottom flap 18 that may align with the key holes 30. In the shown embodiment, the elongated bodies 32 of the pull tabs 22 have a rectangular cross-sectional profile in order to engage the rectangular key holes 30 in the box 12 and the key holes 28 on the fingers 24. The use of a rectangular shape is arbitrary. It will be understood that other shapes, such as round shapes, square shapes and triangular shapes can be used as a matter of design choice. The enlarged heads 34 are sized to be too large to pass through any of the key holes 30.

Figure 3:
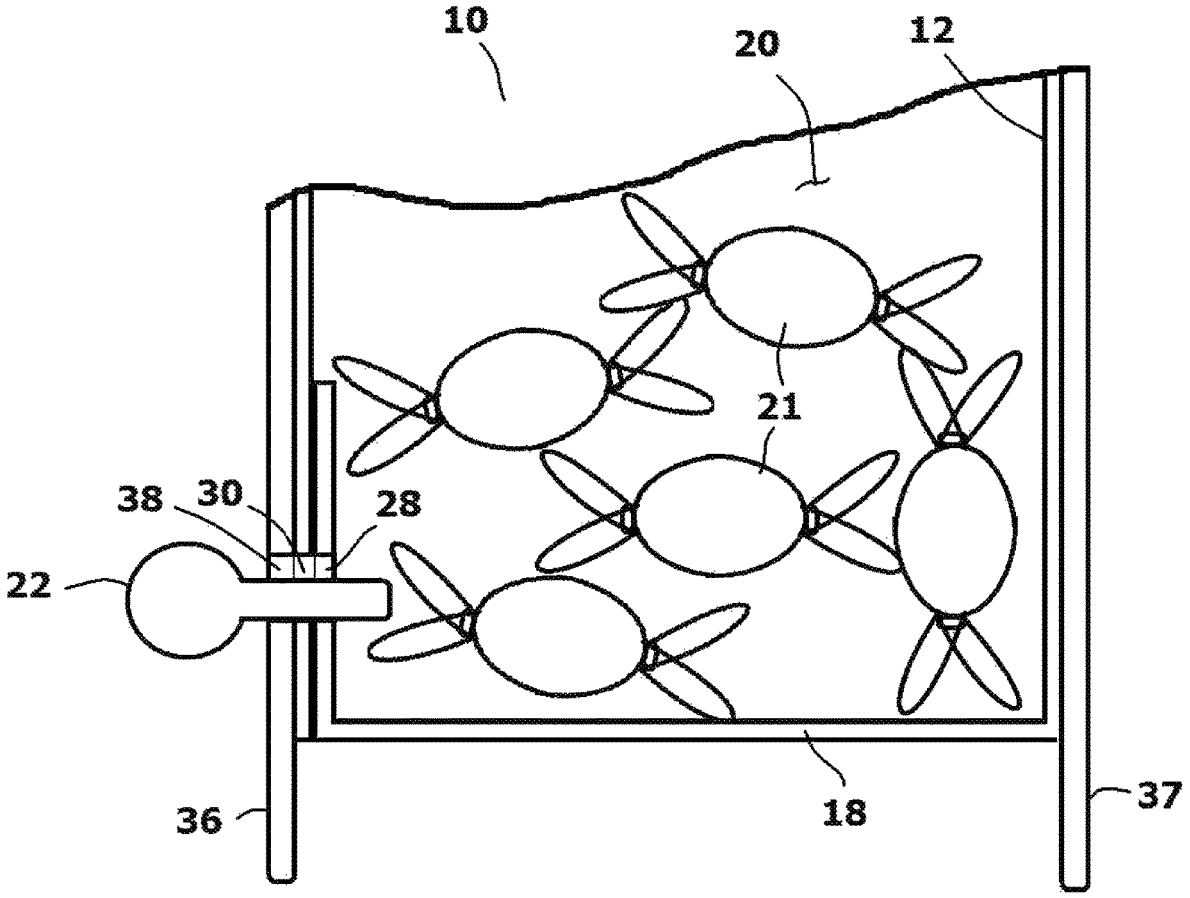
FIG. 3 is a fragmented cross-sectional view of the exemplary pinata shown with a flap in a closed position.

Referring to FIG. 3 in conjunction with FIG. 1 and FIG. 2, it will be understood that in order to load the piñata 10, the bottom flap 18 of the box 12 is closed. With the bottom flap 18 closed, the fingers 24 that extend from the bottom flap 18 lay flush against the front wall 14 of the box 12. The key holes 28 in the fingers 24 align with one or more of the key holes 30 in the front wall 14 of the box 12, including key holes 30 in both the first row 31 and the second row 33.

The pull tabs 22 are inserted into all or most of the key holes 30 in the front wall 14 of the box 12. Some of the pull tabs 22 will pass through the key holes 28 in the aligned fingers 24, therein locking the bottom flap 18 into a closed position. Some of the pull tabs 22 will extend into the gaps 26 between the fingers 24 and will have no effect on the bottom flap 18. With any one pull tab 22 extending through any one key hole 28 in any finger 24, the bottom flap 18 of the box 12 is locked closed and cannot be opened until the appropriate pull tabs 22 are removed.

With the bottom flap 18 locked in its closed position, the box 12 can be filled. The top flap 16 of the box 12 is opened and the box 12 is filled with candy, prizes and/or other objects 21. The box 12 can be partially filled or completely filled, depending upon the preferences of the user.

Figure 4:
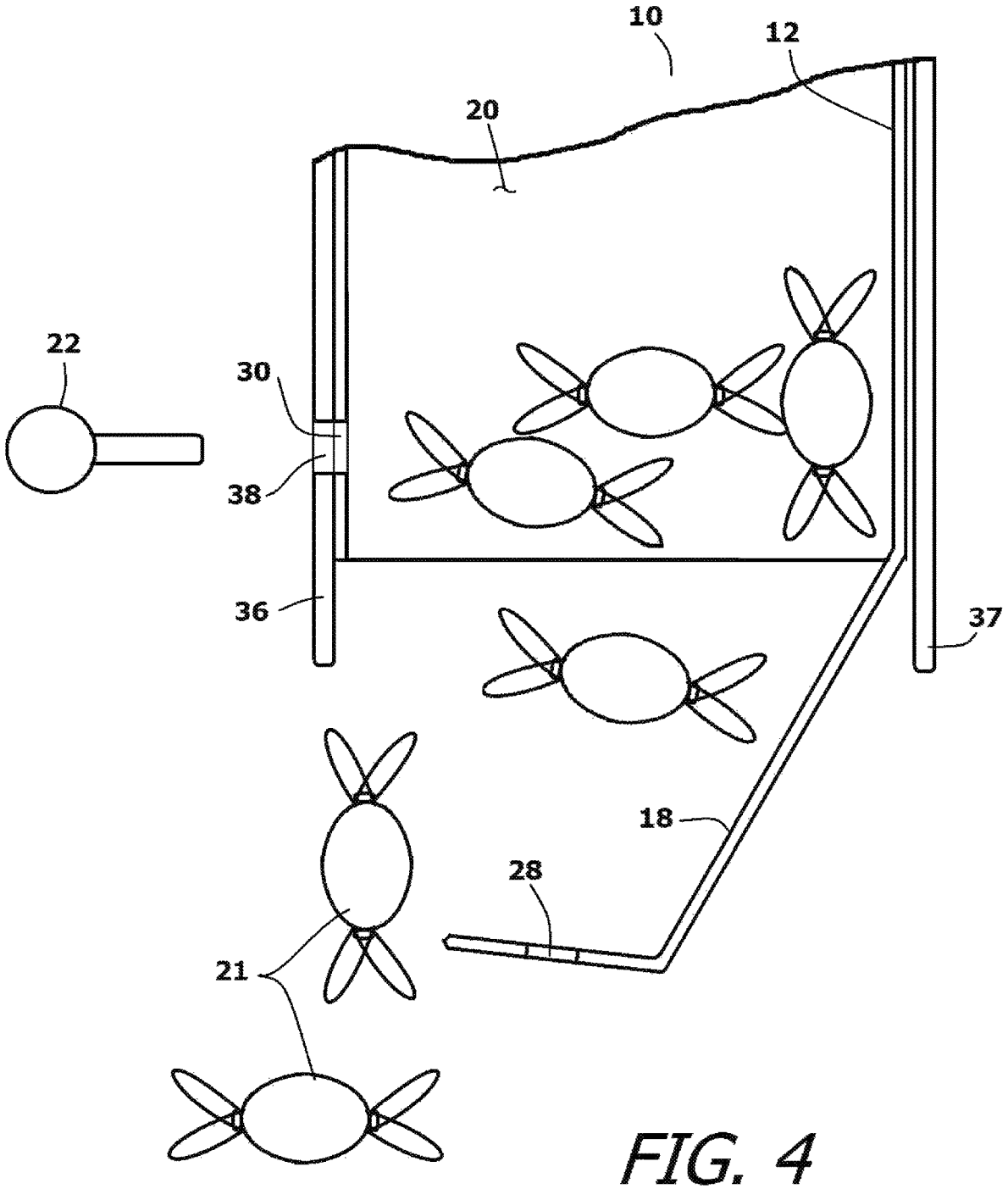
FIG. 4 is a fragmented cross-sectional view of the exemplary pinata shown with a flap in an open position.

Referring to FIG. 4 in conjunction with FIG. 3 and FIG. 2, it will be understood that during play, a person pulls one of the pull tabs 22 from the front of the box 12. The bottom flap 18 of the box 12 will remain closed until all the pull tabs 22 that align with key holes 28 in fingers 24 of the bottom flap 18 are pulled. When no pull tab 22 remains engaged with a key hole 28 on a finger 24, the weight of the candy, prizes, and other objects 21 in the box 12 will cause the bottom flap 18 to swing open. As the bottom flap 18 swings open, the candy, prizes, and other objects 21 contained in the box 12 are released.

Decorative panels 36, 37 can be placed in front and behind the box 12, respectively. The decorative panels 36, 37 can be any shape and can have any graphic art printed thereon. The front decorative panel 36 has panel holes 38 that align with the key holes 30 on the front wall 14 of the box 12. When the pull tabs 22 are inserted into the box 12 to lock the bottom panel 18 in place, the pull tabs 22 are inserted through the panel holes 38, as if the front panel 36 were the front wall 14 of the box 12. This makes the box 12 more decorative and increases play value.

It will be understood that the positions of the pull tabs 22 that trigger the opening of the box 12 may become known to a child after playing with the piñata 10 for a period of time. This problem can be eliminated by adding the ability to adjust the oppositions of the fingers 24 on the bottom flap 18 so that the fingers 24 align with different key holes 30 at different times.

Figure 5:
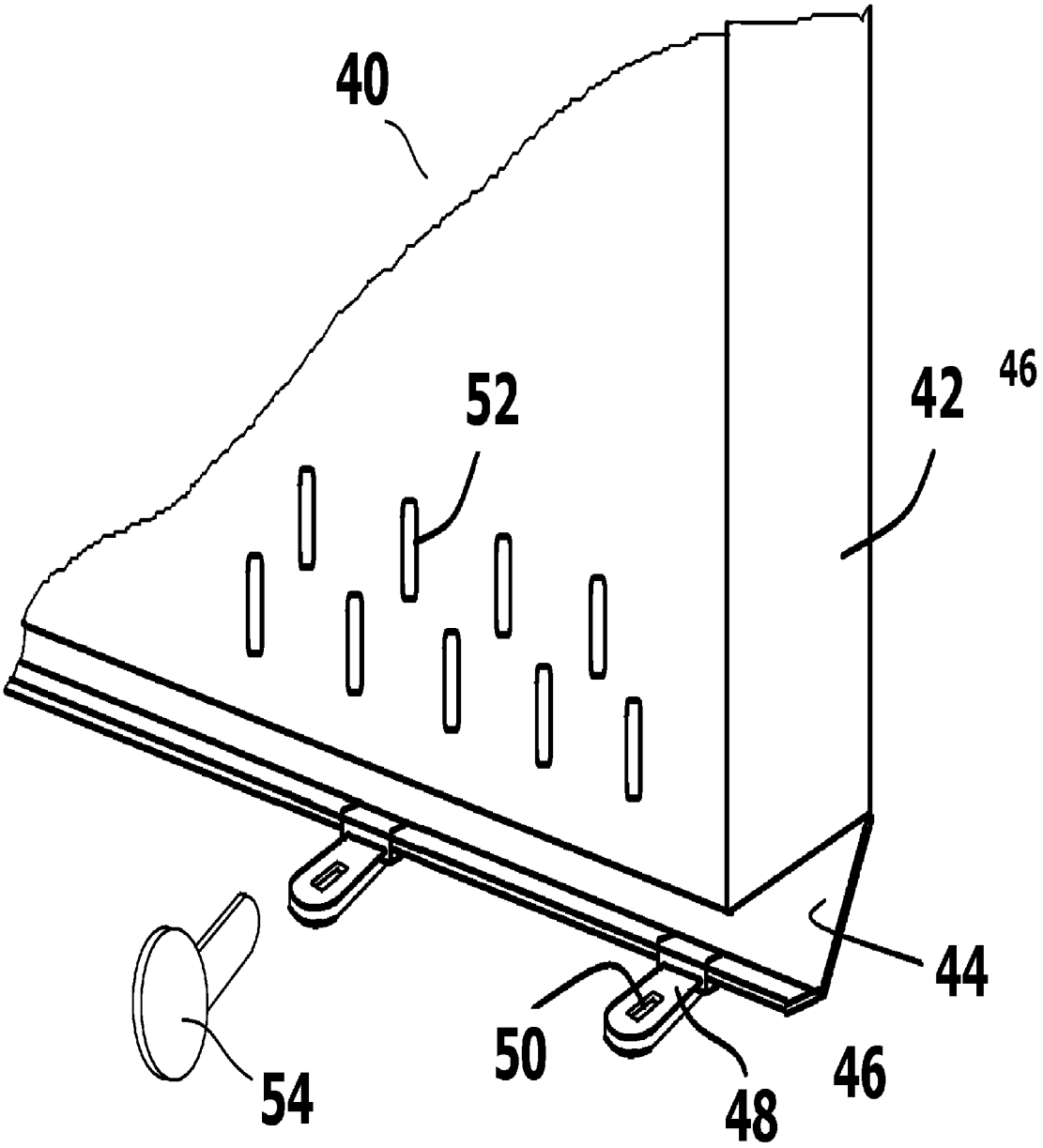
FIG. 5 shows a fragmented perspective view of an alternate embodiment of the reusable piñata system.

Referring to FIG. 5, such an alternate embodiment is shown. In FIG. 5, a pinata 40 is shown having a box 42 and a bottom flap 44. The bottom flap 44 has a lip 46 that folds into the box 42 when the bottom flap 44 is closed. A plurality of sliding fingers 48 are affixed to the lip 46. The sliding fingers 48 can be selectively moved to any position along the length of the lip 46 using manual manipulation. The sliding fingers 48 have key holes 50 that can be selectively aligned with different box holes 52 in the front of the box 42. As such, the positions of the sliding fingers 48 can be adjusted to align with different box holes 52 in the box 42 each time the piñata 40 is used. Once positioned, a slot key 54 is advanced through the box hole 52 and key hole 50 to hold the bottom flap 44 closed. Since the positions of the sliding fingers 48 can be changed, the proper slot keys 54 to remove cannot be learned by a child.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A reusable pinata assembly, comprising:

a container having a front wall, an internal compartment, an open bottom, and a flap that selectively covers said open bottom, wherein said flap is selectively positionable between a closed position that covers said open bottom and an open position that enables access to said internal compartment;

a plurality of box holes formed through said front wall of said container;

a plurality of fingers extending from said flap of said container, wherein at least some of said plurality of fingers are separated by gaps, wherein said plurality of fingers have key holes formed therethrough that align with some of said plurality of box holes in said front wall when said flap is in said closed position; and a plurality of pull tabs that are separate and distinct from said container, wherein said plurality of pull tabs are positioned to extend through said plurality of box holes in said front wall of said container, and wherein some of said plurality of pull tabs extend into said key holes on said plurality of fingers, therein temporarily locking said flap into said closed position, and some of said plurality of pull tabs extend into said gap spaces between some of said plurality of fingers.

2. The assembly according to claim 1, wherein said plurality of fingers includes at least one finger that is positionally adjustable along said flap.

3. The assembly according to claim 1, further including a face panel affixed to said front wall, wherein said face panel contains holes that align with each said plurality of box holes in said container.

4. The assembly according to claim 1, further including a rear panel affixed to said container opposite said face panel.

5. The assembly according to claim 1, wherein said plurality of box holes are arranged on said front wall of said container in at least two rows.

6. The assembly according to claim 1, wherein said internal compartment is filled with loose objects that rest on said flap and bias said flap into said open position.

7. The assembly according to claim 6, wherein said loose objects fall out of said internal compartment when said flap moves to said open position.

8. The assembly according to claim 1, wherein said container is a folded paperboard box.

9. A reusable pinata assembly, comprising:

a box having a front wall, an open bottom, and a flap that selectively covers said open bottom, wherein said box defines an internal compartment;

a plurality of box holes formed through said front wall of said box;

a plurality of fingers extending from said flap, said plurality of fingers having key holes formed therethrough, wherein said key holes align with some of said plurality of box holes when said flap closes said open bottom of said box; and removable pull tabs extending through said plurality of box holes, wherein some of said removable pull tabs extends through both one of said plurality of box holes and said key holes, therein locking said flap in a fixed position.

10. The assembly according to claim 9, wherein at least one of said plurality of fingers is positionally adjustable along said flap.

11. The assembly according to claim 9, further including a face panel affixed to said front wall, wherein said face panel contains panel holes that align with said plurality of box holes in said box.

12. The assembly according to claim 11, further including a rear panel affixed to said box opposite said face panel.

13. The assembly according to claim 9, wherein said plurality of box holes are arranged on said front wall of said box in rows.

14. The assembly according to claim 9, further including a plurality of loose objects that at least partially fill said box, rest on said flap, and bias said flap into an open position.

15. The assembly according to claim 14, wherein said loose objects fall out of said box when said flap moves to said open position.

16. A reusable pinata assembly, comprising:

a container having a front wall, an internal compartment, an open bottom, and a flap that selectively covers said open bottom;

a plurality of box holes formed through said front wall of said container;

a finger attached to said flap that is selectively movable in position along said flap, wherein said finger is alignable with different box holes from among said plurality of box holes; and a removable pull tab extending through said box hole and through said finger, therein temporarily locking said flap over said open bottom.

17. The assembly according to claim 16, further including a face panel affixed to said front wall, wherein said face panel contains holes that align with each of said plurality of box holes in said container.

18. The assembly according to claim 16, wherein said plurality of box holes are arranged on said front wall of said container in rows.

19. The assembly according to claim 16, further including a plurality of loose objects that at least partially fill said container, rest on said flap, and bias said flap into an open position.

* * * * *